US008037786B2

(12) United States Patent
Vatne

(10) Patent No.: US 8,037,786 B2
(45) Date of Patent: Oct. 18, 2011

(54) HYDRAULIC CIRCUIT DEVICE

(75) Inventor: Per A. Vatne, Kristiansand (NO)

(73) Assignee: Wellquip AS, Kristiansand (NO)

( * ) Notice: Subject to any disclaimer, the term of this patent is extended or adjusted under 35 U.S.C. 154(b) by 641 days.

(21) Appl. No.: 11/917,397

(22) PCT Filed: Jun. 2, 2006

(86) PCT No.: PCT/NO2006/000205

§ 371 (c)(1),
(2), (4) Date: Feb. 14, 2008

(87) PCT Pub. No.: WO2006/135244

PCT Pub. Date: Dec. 21, 2006

(65) Prior Publication Data

US 2010/0031647 A1 Feb. 11, 2010

(30) Foreign Application Priority Data

Jun. 13, 2005 (NO) ..... 20052845

(51) Int. Cl.
*E21B 19/16* (2006.01)

(52) U.S. Cl. ..... 81/57.19; 81/57.16; 81/57.21; 81/57.33

(58) Field of Classification Search ..... 81/57.19, 81/57.33, 57.21, 57.34, 57.15, 57.16, 57.2, 81/57.3, 57.44
See application file for complete search history.

(56) References Cited

U.S. PATENT DOCUMENTS 3,023,651 A * 3/1962 Wallace ..... 81/57.2
4,732,061 A * 3/1988 Dinsdale ..... 81/57.19
4,979,356 A * 12/1990 Vatne ..... 81/57.19
5,159,860 A * 11/1992 Pietras ..... 81/57.19
6,082,225 A * 7/2000 Richardson ..... 81/57.19
6,223,629 B1 5/2001 Bangert

FOREIGN PATENT DOCUMENTS

EP 0339005 10/1989
WO 92/18744 10/1992

OTHER PUBLICATIONS

Written Opinion, Sep. 27, 2006, NO PCT Office.

* cited by examiner

*Primary Examiner* — Hadi Shakeri
(74) *Attorney, Agent, or Firm* — GableGotwals

(57) ABSTRACT

A hydraulic circuit device for activating the at least one clamping die (14) of a power tong (1), the power tong (1) including two housing halves (2), pivotable relative to each other, the housing halves (2) being arranged to be pivoted between a closed, active position and an open, inactive position, and a radially divided drive ring (6, 8) which is provided with the at least one hydraulically activated clamping die (14) directed towards the centre axis (10) of the power tong (1), being placed in the housing halves (2), the drive ring (6, 8) being supported and connected to at least one driving motor (12) for the rotation of the drive ring (6, 8) about the centre axis (10), and a hydraulic pump cylinder (16) being articulatedly connected between the first drive ring part (6) of the drive ring (6, 8) and the second drive ring part (8) of the drive ring (6, 8) and arranged to rotate together with the drive ring (6, 8) about the centre axis (10).

6 Claims, 4 Drawing Sheets

HYDRAULIC CIRCUIT DEVICE

CROSS-REFERENCE TO PENDING APPLICATIONS

This application is based on PCT Patent Application No. NO2006/000205, filed on Jun. 2, 2006, which was based on Norwegian Patent Application No. 20052845, filed on Jun. 13, 2005.

This invention relates to a hydraulic circuit. More particularly it concerns a hydraulic circuit for activating the at least one die of a power tong, the power tong including two housing halves, pivotable relative to each other. The housing halves are arranged to be pivoted between a closed active position and an open inactive position. A radially divided drive ring provided with hydraulically activated clamping dies directed towards the centre of the power tong is placed in the housing halves, the drive ring being supported and connected to a drive for the rotation of the drive ring about a substantially vertical axis which coincides with said centre, and a hydraulic pump cylinder being articulatedly connected between a first drive ring part and a second drive ring part.

In connection with drilling operations in the ground, in which joinable drill pipes are used, for example in the recovery of petroleum, mechanized pipe tongs in the form of power tongs are well known and used extensively.

Power tongs of this kind normally include hydraulically or mechanically activated grippers or clamping dies which are arranged to clamp a pipe grippingly.

It is common that power tongs either can be opened or are provided with a radial opening, so that the power tongs can be moved in a radial direction to and from the pipe.

When using hydraulically activated clamping dies, which have to be located in a clamping die holder rotatable with the pipe, because of the configuration of the power tong, it is problematic to get hydraulic pressure fluid transferred to the clamping cylinders.

Several solutions are known. One solution is to place a hydraulic circuit including a hydraulic fluid reservoir, a pump and necessary valves in the clamping die holder. The pump may be formed as a piston pump driven by a hydraulic cylinder located externally to the clamping die holder, as it is described in the WO document 92/18744.

However, this device has a clear disadvantage in that the power tong has to be stationary during the operation of the positive displacement pump by said hydraulic cylinder. The device according to WO 92/18744 thus entails time loss during each make-up operation.

The invention has as its object to remedy or reduce at least one of the drawbacks of the prior art.

The object is achieved in accordance with the invention through the features specified in the description below and in the subsequent Claims.

The power tong according to the invention is of the kind that includes two housing halves, pivotable relative to each other, the housing halves being arranged to be pivoted between a closed active position and an open inactive position. A radially divided drive ring, which is provided with hydraulically activated clamping dies directed towards the centre of the power tong, is placed in the housing halves. The drive ring is supported and connected to a drive for the rotation of the drive ring about the centre axis of the power tong. According to the invention, the power tong is provided with a hydraulic pump cylinder, which is articulatedly connected between a first drive ring part and a second drive ring part.

During the opening of the power tong, the first drive ring part is in one of the housing halves, whereas the second drive ring part is in the other housing half. When the housing halves are pivoted away from each other, the first drive ring part is also pivoted away from the second drive ring part, whereby the piston rod of the pump cylinder is moved out of the pump cylinder. When the housing halves are pivoted back into their closed position, the piston rod is moved into the pump cylinder.

This piston rod movement is used to pump hydraulic fluid from a hydraulic fluid reservoir into an accumulator.

When the clamping dies are to be moved into engagement round a pipe, hydraulic fluid is directed via control valves to the respective clamping die cylinders. By the clamping dies cylinders communicating with the accumulator the clamping dies are kept tightened against the pipe.

When the clamping dies are to be withdrawn from the pipe, the connection to the accumulator is shut off, hydraulic fluid then flowing out from the clamping die cylinders, whereby the clamping dies are moved back by their respective return springs.

In a preferred embodiment the hydraulic fluid flows from the clamping die cylinders into a container of limited volume to prevent the clamping dies from moving unnecessarily far back. An unnecessarily long return stroke will require relatively much hydraulic fluid to be supplied from the accumulator in the subsequent clamping operation.

The limited volume is preferably formed by a volume cylinder, the piston area of the volume cylinder being considerably larger on the plus side of the cylinder than on its minus side. See further explanation in the specific part of the description.

The hydraulic circuit according to the invention is controlled by a directional valve, the control means of the directional valve being influenced by a control ring that is stationary relative to the drive ring. The control ring is moved to and from the directional valve by means of hydraulic control cylinders. When the control ring is moved in towards the directional valve, the directional valve directs hydraulic fluid to the clamping die cylinders. During rotation of the drive ring in the housing halves, the control means of the directional valve bears, when the directional valve is activated, on the control ring.

The pump cylinder may, with advantage, be provided with a surrounding hydraulic fluid reservoir.

When a hydraulic circuit according to the invention is used in connection with a power tong, the filling up of the accumulators with hydraulic fluid takes place under pressure as the power tong closes. Thus, it is unnecessary to connect a hydraulic circuit to an external fluid supply or to a mechanical transmission for the necessary pressure fluid to be supplied.

In what follows is described a non-limiting example of a preferred embodiment which is visualized in the accompanying drawings, in which.

Figure 1:
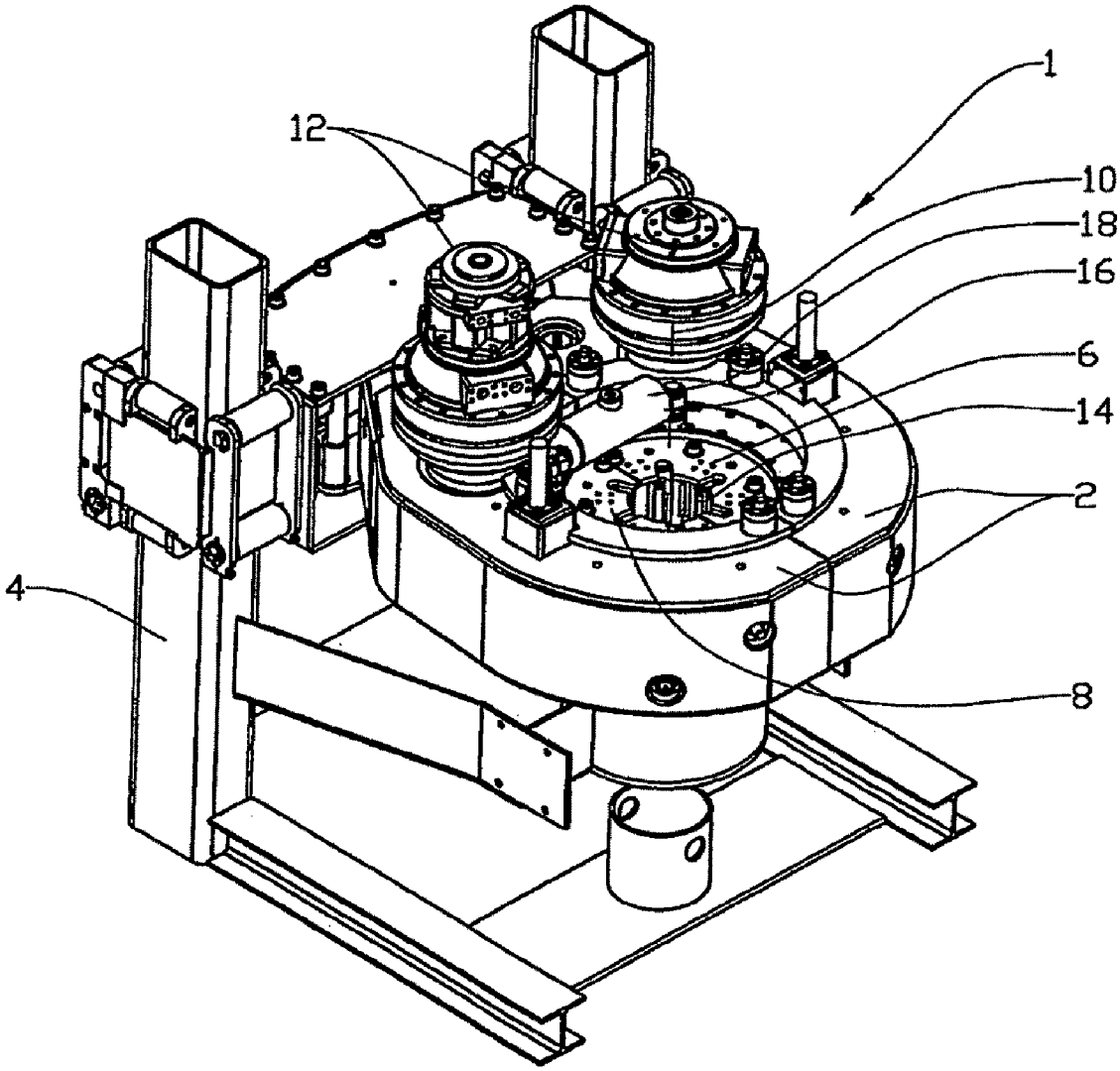
FIG. 1 shows a power tong according to the invention.

In the drawings the reference numeral 1 denotes a power tong including two housing halves 2 which are pivotable relative to each other and are connected, jointly liftable and lowerable, to a support 4 in a manner known per se.

A two-part drive ring includes a first drive ring part 6 and a second drive ring part 8 which can be interconnected so that they form one drive ring and which are arranged to be rotated about their own centre axis 10 by means of driving motors 12 when the housing halves 2 are in their closed, active position, see FIG. 1.

A number of clamping dies 14 which are located in the drive ring parts 6 and 8 are radially movable and arranged to grip round a pipe, not shown.

The housing halves 2 are prevented from being pivoted from their closed position until the drive ring parts 6 and 8 are locked within their respective housing halves 2.

Figure 3:
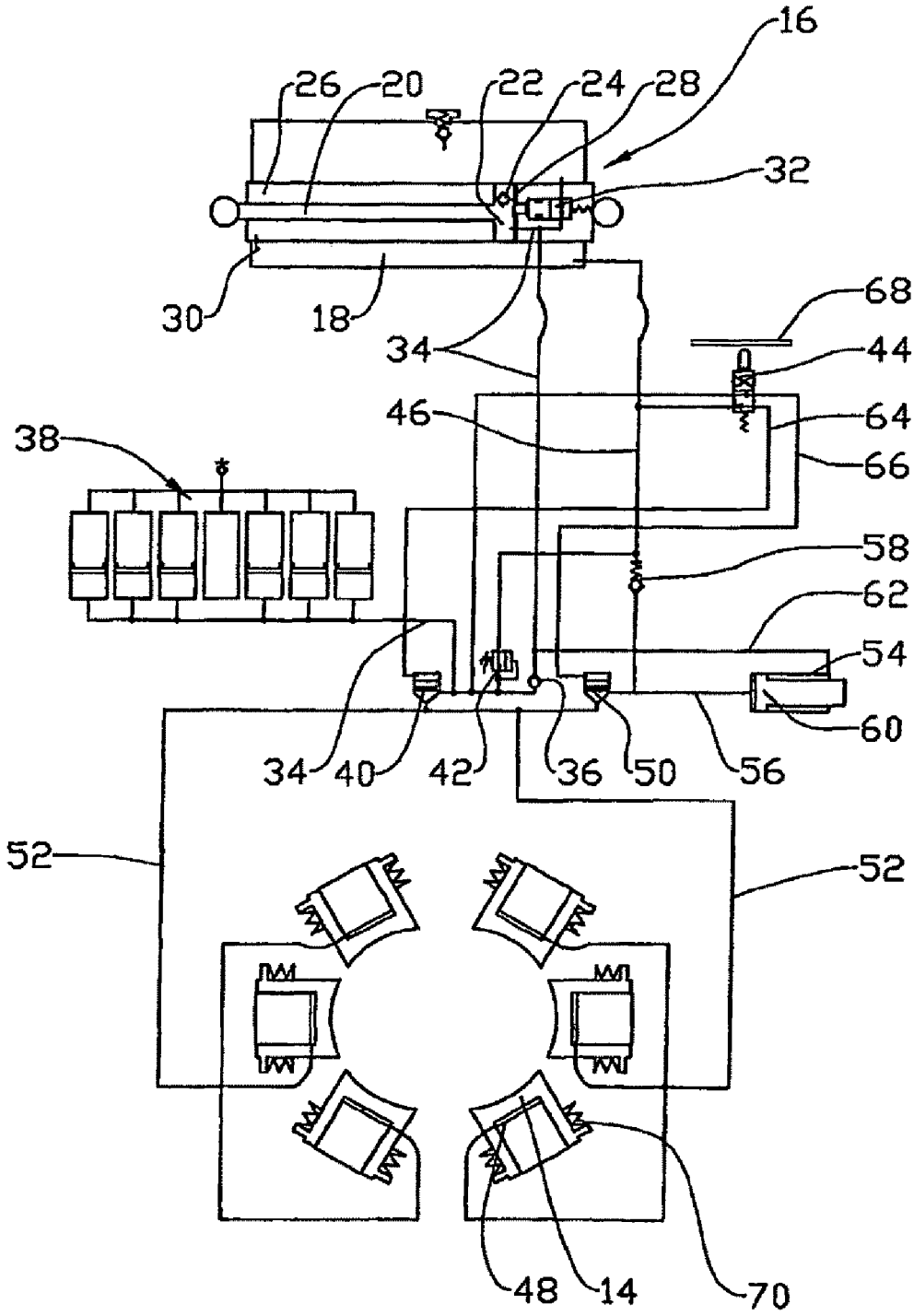
FIG. 3 shows a hydraulic circuit for controlling the clamping dies of the power tong.
Figure 4:
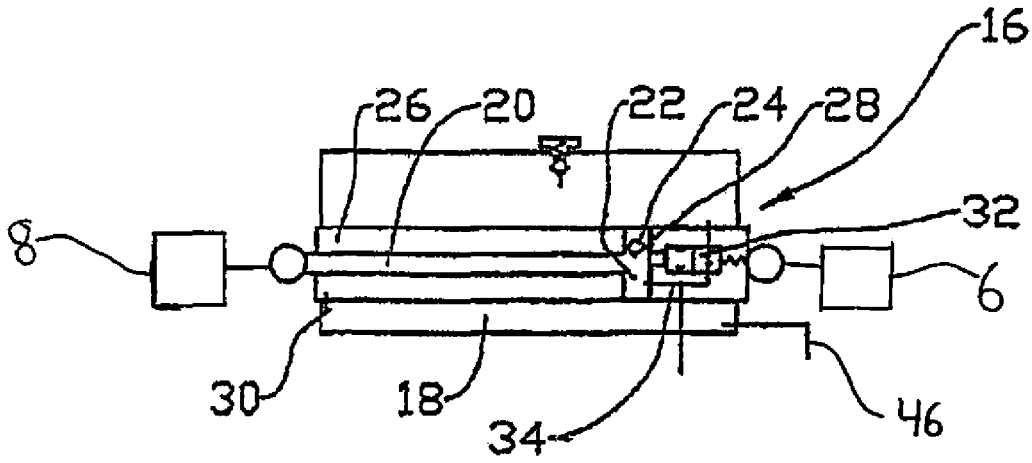
FIG. 4 shows a hydraulic pump cylinder being articulatedly connected between the first and second drive ring parts.

As seen in FIG. 4, a pump cylinder 16 is articulatedly connected between the drive ring parts 6 and 8, the housing of the pump cylinder 16 including a hydraulic fluid reservoir 18 being connected to the first drive ring part 6, the piston rod 20 of the pump cylinder 16, see FIG. 3, being connected to the second drive ring part 8. The pump cylinder 16 rotates together with the drive ring parts 6 and 8. The pump cylinder 16 is located on the inside of the centre axis 10 when the housing halves 2 are to be pivoted away from each other.

The piston rod 20 thus moves out of and into the pump cylinder 16 when the housing halves 2 pivot into an open, respectively a closed position.

The piston 22 of the pump cylinder 16, see FIG. 3, is provided with a first check valve 24 allowing the flow of hydraulic fluid from the minus chamber 26 of the pump cylinder 16 into the plus chamber 28 of the pump cylinder 16. In FIG. 3, the plus chamber 28 takes its smallest volume.

The minus chamber 26 communicates with the hydraulic fluid reservoir 18 through an opening 30.

A relief valve 32 communicates with the plus chamber 28 via a pressure pipe 34, the relief valve 32 connecting the plus chamber 28 with the hydraulic fluid reservoir 18 when the piston 22 is in its minus position.

The pressure pipe 34 extends by way of a second check valve 36 to an accumulator group 38, an activating valve 40, an overpressure valve 42 and a directional valve 44.

The overpressure valve 42 is arranged to open for the return flow of hydraulic fluid via a return pipe 46 to the hydraulic fluid reservoir 18 if the hydraulic fluid pressure in the accumulator group 38 exceeds a predetermined value.

The return pipe 46 is also connected to the outlet of the directional valve 44.

Each of the clamping dies 14 is provided with a clamping die cylinder 48, which communicates with the activating valve 40 and a return valve 50 by way of an activating pipe 52.

The return valve 50 communicates with the plus side of a volume cylinder 54 via a plus side pipe 56, the plus side pipe 56 communicating with the return pipe 46 by way of a second overpressure valve 58.

The piston 60 of the volume cylinder 54 has a considerably larger area on its plus side than on its minus side, the minus side of the volume cylinder 54 communicating via a minus side pipe 62 with the pressure pipe 34 in a position between the pump cylinder 16 and the second check valve 36. Said difference in area has the effect that there is used relatively little hydraulic fluid under pressure to move the piston 60 back to the starting point.

Figure 2:
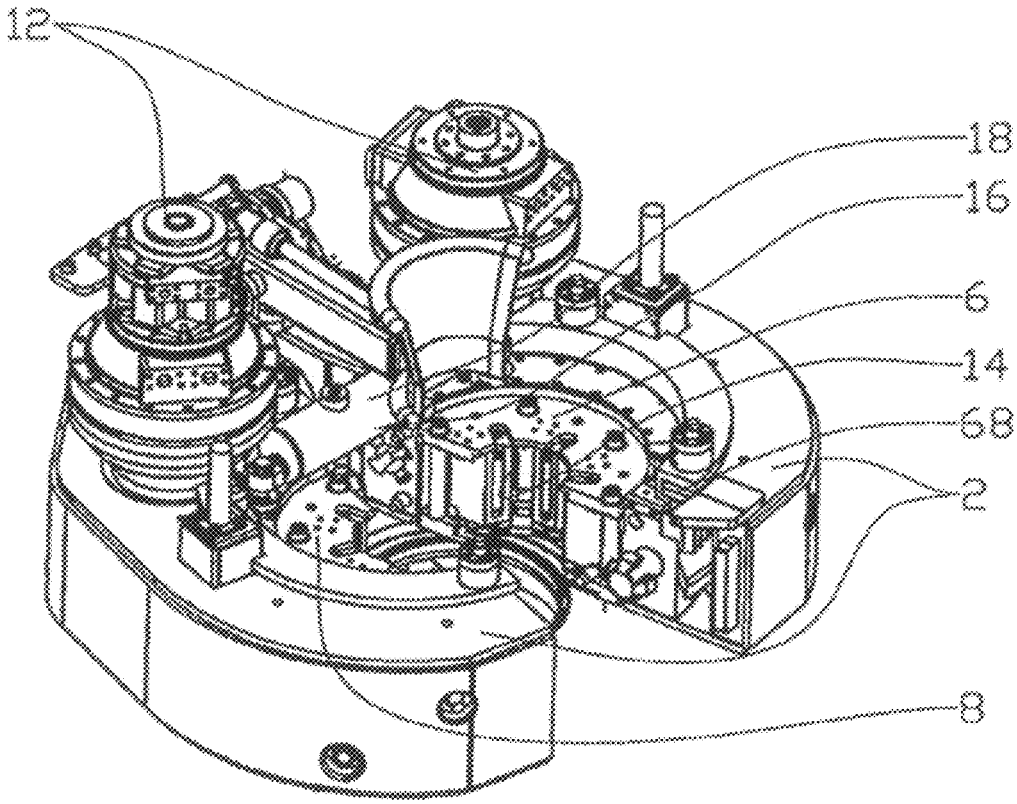
FIG. 2 shows the housing halves of the power tong in an open position.

The activating valve 40 and return valve 50 are controlled by the directional valve 44 via a first control pipe 64 and a second control pipe 66, respectively. The directional valve 44 is operated by moving a control ring 68, see also FIG. 2.

When the housing halves 2 are pivoted away from each other, the piston rod 20 with the piston 22 is moved in the direction out of the pump cylinder 16, the relief valve 32 closing immediately after the movement has started. Hydraulic fluid flows, as the piston 22 is moving, via the first check valve 24 from the minus chamber 26 and from the hydraulic fluid reservoir 18 into the plus chamber 28.

When the housing halves 2 are pivoted towards each other, the piston 22 is moved in the minus direction, whereby hydraulic fluid flows under pressure via the pressure pipe 34 and the second check valve to the accumulator group 38. Hydraulic fluid under pressure is directed via the directional valve 44 and the second control pipe 66 to the control port of the return valve 50.

A relatively small volume of fluid also flows through the minus side pipe 62 to the minus side of the volume cylinder 54, whereby the piston 60 is moved in its minus direction displacing hydraulic fluid present in the plus chamber of the volume cylinder 54 via the plus side pipe 56, return valve 50 and activating pipe 52 to the clamping die cylinders 48.

Fluid may flow via the second overpressure valve 58 and return pipe 46 to the hydraulic fluid reservoir 18 as overpressure arises in the clamping die cylinders 48.

As the piston 22 reaches its minus position, the relief valve 32 is shifted, so that hydraulic fluid in the plus chamber 28 and pressure pipe 34 up to the second check valve 36 may be drained into the hydraulic fluid reservoir 18.

When the control ring 68 shifts, the directional valve 44 moves so that hydraulic fluid under pressure can flow through the first control pipe, whereas the second control pipe 66 is relieved into the return pipe 46. Thereby the activating valve 40 opens for hydraulic fluid to flow from the accumulator group 38 via the activating pipe 52 into the clamping die cylinders 48, whereby the clamping dies 14 are moved and brought into engagement with the pipe, not shown.

When the clamping 14 are to be moved back, the control ring 68 is moved away from the directional valve 44, so that the directional valve 44 is shifted. Thereby the activating valve 40 closes whereas the return valve 50 opens.

Due to the return springs 70 of the clamping dies, hydraulic fluid will now flow via the activating pipe 52, return valve 50 and plus side pipe 56 to the plus side of the volume cylinder 54. The piston 60 is thereby moved into its plus position, whereby the volume cylinder 54 receives a sufficient amount of hydraulic fluid from the clamping die cylinders 48 for the clamping dies to be withdrawn a desired distance, but not more than necessary, in order that the amount of hydraulic fluid needed from the accumulator group 38 to push the clamping dies forward, will not be too large.

The invention claimed is:

1. A hydraulic system for activating at least one hydraulically actuated clamping die of a power tong, said hydraulic circuit comprising:

a power tong, at least one clamping die, a hydraulic cylinder pump, an accumulator, a first check valve, at least one clamping die cylinder, a volume cylinder and an activating valve;

wherein said power tong having two housing halves, pivotable relative to each other, and a radially divided drive ring having a first drive ring part and a second drive ring part, said housing halves being arranged to be pivoted between a closed, active position and an open, inactive position, said drive ring being located in said housing halves and supported and connected to at least one driving motor for the rotation of said drive ring about a centre axis and having one of said at least one hydraulically activated clamping die directed toward said centre axis, said hydraulic pump cylinder being articulatedly connected between said first drive ring part and said second drive ring part and arranged to rotate with said drive ring about said centre axis;

wherein, said hydraulic pump cylinder being in communication with said accumulator via said first check valve, said accumulator being in communication with said clamping die cylinder through said activating valve; and a volume cylinder; and wherein a hydraulic fluid flowing from said clamping die cylinder is directed into said volume cylinder, said volume cylinder being limited in volume and sized to receive an effective amount of hydraulic fluid for the purpose of withdrawing said clamping die a desired distance.

2. The hydraulic system in accordance with claim 1 wherein said first drive ring part is located in one of said housing halves and said second drive ring part is located in the other of said housing halves as said housing halves are being pivoted from the closed, active position to the open, inactive position.

3. The hydraulic system in accordance with claim 1 wherein said volume cylinder is comprising a piston having a plus side and a minus side, said piston having a substantially larger area on said plus side than on said minus side.

4. The hydraulic system in accordance with claim 1 further comprising a directional valve and a control ring, said directional valve being influenced by said control ring, said control ring being stationary relative to said housing halves.

5. The hydraulic system in accordance with claim 4 wherein said control ring is moved to and from said directional valve by a hydraulic control cylinder.

6. The hydraulic system in accordance with claim 1 wherein said hydraulic pump cylinder comprises a hydraulic fluid reservoir.

* * * * *